US010035612B2

(12) United States Patent
Fabrizi

(10) Patent No.: US 10,035,612 B2
(45) Date of Patent: Jul. 31, 2018

(54) PORTABLE PAPER STACKING AND STORAGE DEVICE

(71) Applicant: Daniel Fabrizi, Garden City, NY (US)

(72) Inventor: Daniel Fabrizi, Garden City, NY (US)

( * ) Notice: Subject to any disclaimer, the term of this patent is extended or adjusted under 35 U.S.C. 154(b) by 203 days.

(21) Appl. No.: 14/929,977

(22) Filed: Nov. 2, 2015

(65) Prior Publication Data

US 2016/0122050 A1 May 5, 2016

Related U.S. Application Data

(60) Provisional application No. 62/074,084, filed on Nov. 2, 2014.

(51) Int. Cl.
*B65B 27/08* (2006.01)
*B65B 13/26* (2006.01)

(52) U.S. Cl.
CPC ..... *B65B 27/08* (2013.01); *B65B 13/26* (2013.01); *B65B 27/083* (2013.01)

(58) Field of Classification Search
CPC ..... B65D 85/62; B65B 27/08; B65B 27/083; B65B 27/086; B65B 13/26; Y10T 24/1404
USPC ..... 100/34
See application file for complete search history.

(56) References Cited

U.S. PATENT DOCUMENTS 946,486 A * 1/1910 Brassington ..... G09F 3/0352 24/18
1,062,491 A * 5/1913 Mershon ..... B65D 63/14 24/18
1,175,781 A * 3/1916 Loudon ..... B65D 63/14 24/18
1,223,596 A * 4/1917 McSwiney ..... B65D 63/14 24/18
3,780,854 A * 12/1973 Ruppenthal ..... B65B 27/083 100/34
5,109,762 A * 5/1992 Tetrault ..... B65B 27/083 100/2
5,114,020 A * 5/1992 Martin ..... B26D 11/00 100/34
5,388,687 A * 2/1995 Philip ..... B65B 27/083 100/34

* cited by examiner

*Primary Examiner* — Shelley Self
*Assistant Examiner* — Mohammad Yusuf
(74) *Attorney, Agent, or Firm* — Carrie Stroup

(57) ABSTRACT

A hand-sized, disposable device, and its method of use for bundling and transporting a stack of small consumer goods, such as boxes, newspapers and magazines for recycling. The method comprises dispensing a pre-cut loop of twine residing in a prefabricated device made of recyclable paper board or cardboard. The twine crosses itself in the cavity of the device and is free to slide in any direction via four total device corner holes for adjusting to a range of sizes of stacked goods. Bundling is completed by drawing two opposing ends of the twine loop from the device corner holes, passing the two ends perpendicularly and simultaneously over the four sides of a stack of goods, and forming a knot on the center of the bundle's top surface. The bundle may then be easily lifted, carried, dropped and disposed of via the knot, one-handedly, without slippage of items from the bundle.

20 Claims, 12 Drawing Sheets

PORTABLE PAPER STACKING AND STORAGE DEVICE

PRIORITY CLAIM

This application claims priority to U.S. Provisional Patent Application Ser. No. 62/074,084 filed on Nov. 2, 2014 and incorporated herein in its entirety by this reference thereto.

FIELD OF THE INVENTION

In general the present invention relates to a device for bundling small consumer goods. In particular, the present invention relates to a hand-sized, disposable device for bundling newspapers, magazines, card board boxes, etc., for easy stacking, storage, recycling, and transport.

BACKGROUND OF THE INVENTION

If an individual wishes to discard a stack of small stackable consumer goods, such as used magazines, newspapers, and card board boxes (e.g. cereal boxes), they often pick-up a stack of loose goods and carry the stack two-handedly against their body to the trash bin, or they load them in their vehicle for transport to a recycling facility. Often some goods will be dislodged from this stack during this process.

The individual may also store the goods in bins (e.g. recycling bins) or other containers that they then need to lift two-handedly for carrying to the curb or to their vehicle. They then need to return the emptied bin to its location once the goods have been disposed of.

Another common method comprises tying a rope or twine around the bundle. This is not an easy manual task as it requires picking the bundle up and trying to twist a twine around all sides of the bundle. Unless this is expertly done, the twine will often slip loose and some goods will fall out as the stack is being moved and/or dropped.

Therefore, there is a need within the paper goods and recycling industry for an inexpensive, disposable, portable device to enable a user to easily and safely: bundle, lift, transport, and drop a stack or bale of small, flat, stackable consumer goods (e.g. newspapers, magazines, collapsed boxes, etc.). The user should be able to easily lift and carry the bundle with one hand. And the bundling or stacking device should not require storage bins or other containers to keep the items from scattering. Instead the device should be disposable and recyclable such that it does not need to be removed from the goods before they are placed in a recycling bin or garbage container. It would also be especially advantageous if the device were small and lightweight, such as one that is able to fit within a user's hand. The device of the present disclosure possesses all of these features.

SUMMARY OF THE INVENTION

The various embodiments of the present invention are concerned with facilitating the baling or stacking of goods, particularly paper goods for recycling, by method of dispensing a pre-cut loop of twine residing in a prefabricated container made of recyclable paper board or cardboard. The twine crosses itself in the cavity of the box and is free to slide in either direction for adjusting to any size stack of goods and to align the knot with the center of the top of the stack. Baling is completed by drawing the twine from each end of the dispenser, passing the twine over items to be baled, and forming a knot.

As disclosed herein, there are two primary embodiments of the device. The first embodiment is made of recycled paper board, and it is substantially square, flat-shaped when assembled. There are two ends of a loop of twine lying against the bottom surface on the right and left side of the device and extending out from four total holes, comprising two holes on the right and two holes on the left side of the device (see FIGS. 2A, 10A). The front and rear device sides are also sharply angled downward and inward, while the right and left side are vertical (see FIGS. 4, 5).

The second embodiment is made of recycled cardboard on the top surface and paper board on the bottom surface. It is substantially square shaped on the top and bottom surface when assembled, with a vertical front and rear sides created by the grooves of the corrugated cardboard that run side-to-side within the device. It further comprises a body of a loop of twine lying within the device in a circular cavity which is carved into the top surface, and the ends of the loop extend out the sides of the device along corrugated grooves within the cardboard material (see FIG. 10B). Additionally, in an embodiment, the right and left sides are angled downward and inward, about forty-five degrees, which is created by the top surface of cardboard being slightly wider than the bottom surface of paper board on the right and left sides.

The paper board embodiment unassembled is fabricated from a single blank flat piece of paper board. The device blank-unassembled comprises: a top rectangular section comprising two long and two short ends, and positioned vertically with a short end adjoining a mid-section long end; a rectangular mid-section comprising two long and two short ends, positioned horizontally between the top section and a bottom section; two small rectangular side sections with one each positioned vertically on opposing right and left sides of the mid-section; a thin rectangular bottom section positioned opposite the top section, and adjoining the mid-section.

The paper board embodiment unassembled further comprises four total semi-circle cutouts located on the device outer perimeter. One of each of the semi-circles is located on the two corners (or junctures) between the top section and the mid-section; and at two corners located between the mid-section and the bottom section. The diameter of the semi-circle is slightly wider than the diameter of the twine so that it may easily pass through the device's holes.

The method of assembling the paper board embodiment comprises: folding the right and left sides onto the mid-section (e.g. rotate about 180 degrees) along their respective outer perforation line; folding the top section at its bottom perforation line over the mid-section; and permanently adhering (e.g. via adhesive) the top end of the top section to the bottom section.

The card board embodiment unassembled comprises a top section of corrugated cardboard, cut in a square shape, with the grooves running horizontally between the right and left sides of the device. A circular cavity is cut into the center of the top section to allow space for the twine to be inserted. A bottom section made of un-corrugated material, e.g. paper board, is glued over the top section, locking the body of the twine within the cavity.

The method of use of either embodiment comprises: providing a baling or stacking device as disclosed herein; pulling the two loop ends simultaneously over opposing corners of a stacked good, such as a stack of newspapers; tying the two loop ends into a secure knot in a center of a top surface of the stack; and lifting and transporting the stack by securely holding the knot one-handedly.

An object of the prevent disclosure is providing a lightweight, portable device and its method of use for easily lifting, carrying, and dropping of a bundle of small goods, such as used magazines and newspapers for recycling, by clasping the device's top knot one-handedly. Therefore, a user does not need to bend over to the ground to lift a stack of goods, and thus risk injury to their back. And they do not need to carry the stack in both arms and against their chest, which may obstruct their view. When using this device, the user has one hand free to safely navigate stairs and other rough terrain.

Another object is providing a device for easily bundling a wide variety of types of stacked flat items, such as folded laundry, papers (letter and legal sized) and folders, paperback books, collapsed boxes, etc.

Another object is providing an inexpensive, recyclable device that can be disposed of with the baled goods. For example, if the goods are collapsed boxes, newspapers and/or magazines that will be deposited in a recycling machine, then the device does not need to be removed beforehand. The various embodiments of the device disclosed herein are made of recyclable paper, cardboard, and twine.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

Objects, features, and advantages of the invention will be brought out further in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

DETAILED DESCRIPTION OF THE PREFERRED EMBODIMENTS OF THE INVENTION

Figure 1:
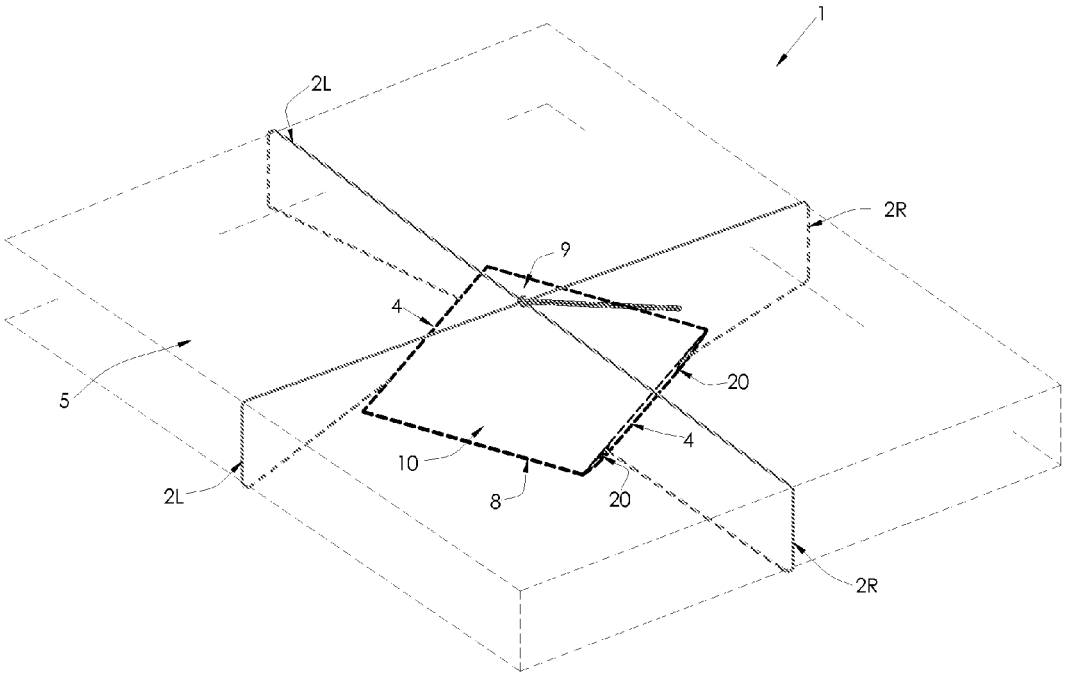
FIG. 1 is a perspective view of the paper board embodiment with a bale of papers.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting. The top and four sides of the bale (i.e. stacked goods) are in direct contact with the two ends of a loop of twine extending from a cavity within the device, and the bottom of the bale is in direct contact with the top surface of the device.

Now referring to drawings in FIGS. 1-11, wherein similar components are identified by like reference numerals, there is seen in FIG. 1, a perspective view of the paper board embodiment comprising the stacking or baling device 1 positioned around a stack or bale of paper (dotted lines 5). The top surface 10 of the device 1 is in direct contact with the bottom of the stack 5 of papers. The four sides of device 1: right and left 4, front side 8, and rear side 9, are situated in an angular manner relative to the sides of the stack of papers. This facilitates the loop of twine 2 extending perpendicularly around each side of the stack (see FIG. 1, 2R, 2L, top and bottom of device 1).

Paper Board Versus Cardboard Embodiments

Figure 6A:
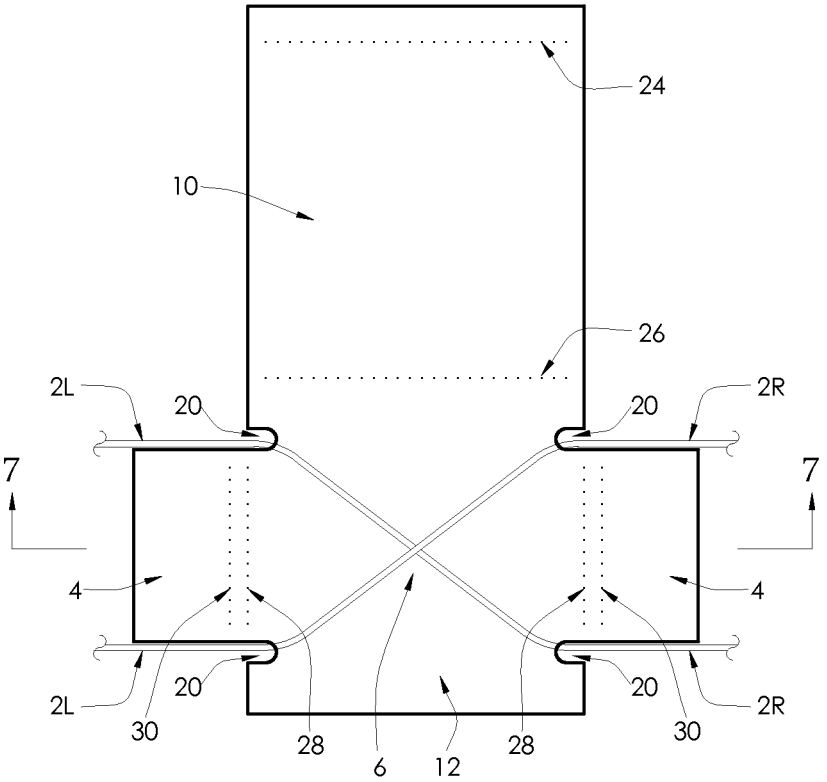
FIG. 6A is a top plan view of the paper board embodiment in an unassembled configuration.

Device 1 further comprises a loop of twine 2 that crisscrosses within the center cavity 3 of the device 1 (i.e. see FIG. 6A, "6"). In the cardboard embodiment, a circular cavity 3 is cut into the center of the device top surface to house the twine (see FIG. 6B). When the device is pre-used, the two loop ends 2R (right), 2L (left) are taut against the bottom of device 1 in the paper board embodiment (see FIGS. 10A, 11), and against the right and left sides of device 1 in the card board embodiment (see FIGS. 9, 10B). In both embodiments, the remainder of the loop remains rolled within cavity 3 untangled for easy extension when the user pulls on the loop ends 2R, 2L.

Figure 10A:
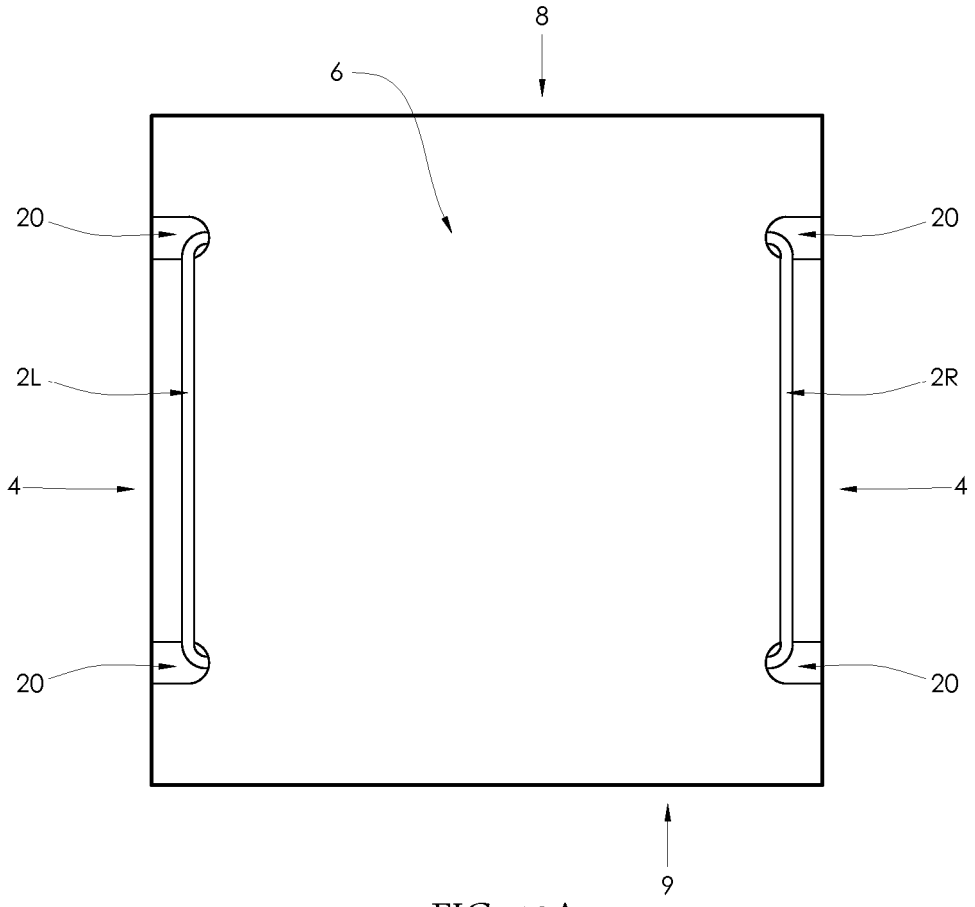
FIG. 10A is a bottom view of the paper board embodiment showing the twine in a pre-used taut position against the device bottom surface.
Figure 11:
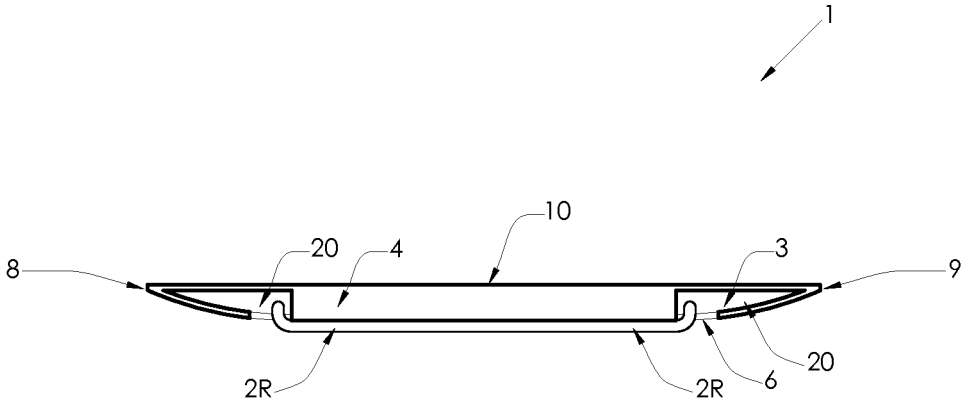
FIG. 11 is a right side view of the paper board embodiment of FIG. 10A.

In the paper board embodiment, the loop of twine 2 extends outward from four holes 20 located on the right and left sides 4 of the device near the corners (see FIGS. 10A, 11). The skilled artisan may easily adjust the location of the four holes 20 on the device's right and left side 4 while maintaining the ability of the twine 2 to extend from the device in four perpendicular directions simultaneously.

In the card board embodiment, the loop of twine 2 lies within grooves positioned from left to right (horizontally) within the card board. The twine extends outward from device 1 right and left sides via the grooves (see FIG. 9, 10B). The skilled artisan may easily select the location of the two parallel grooves that the two ends of twine extend from while maintaining the ability of the twine 2 to extend from device 1 in four perpendicular directions simultaneously.

Additionally, in the paper board embodiment of device 1 as illustrated in FIGS. 1, 2A, 4, 5, 6A, and 11, a thin shaped straight line edge comprises the front side 8 and rear side 9. And, in the exemplified embodiment, the front and rear side of the paper board embodiment are sharply angled downward and inward (see FIG. 11 side view, front "8" and rear side "9" comprising about a 78 degree downward and inward angle towards the bottom surface 6).

Figure 2A:
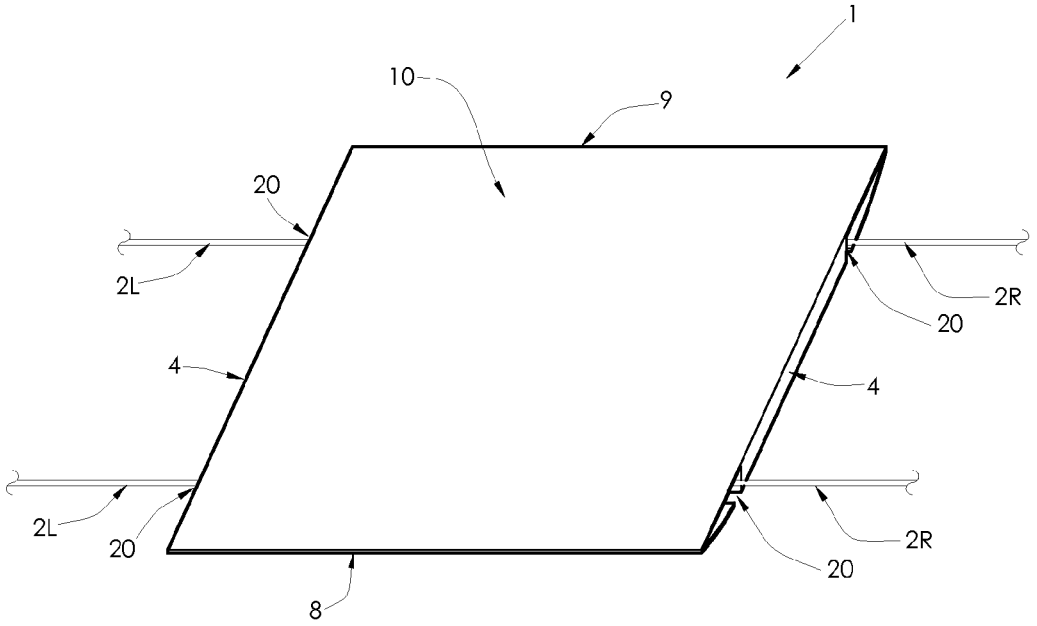
FIG. 2A is a top front perspective view of the paper board embodiment.
Figure 2B:
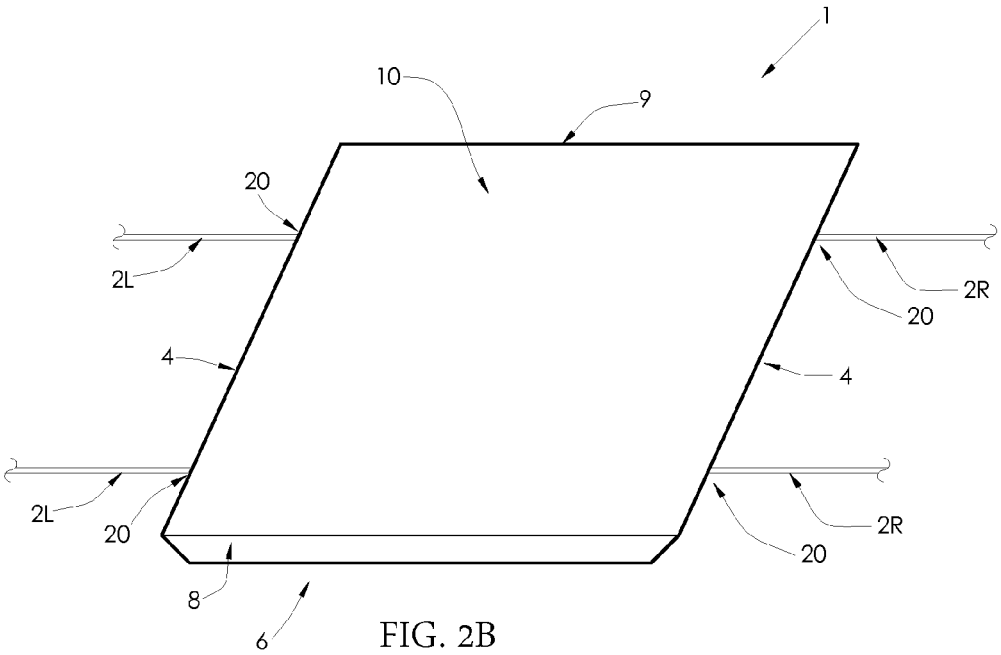
FIG. 2B is a top front perspective view of the cardboard embodiment.
Figure 3:
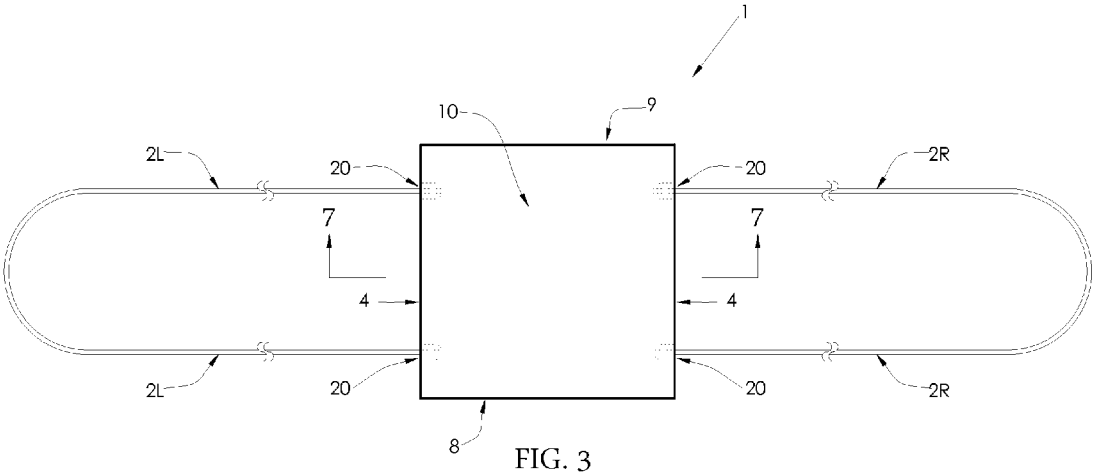
FIG. 3 is a top plan view of both embodiments with the opposing loop ends extended.
Figure 4:
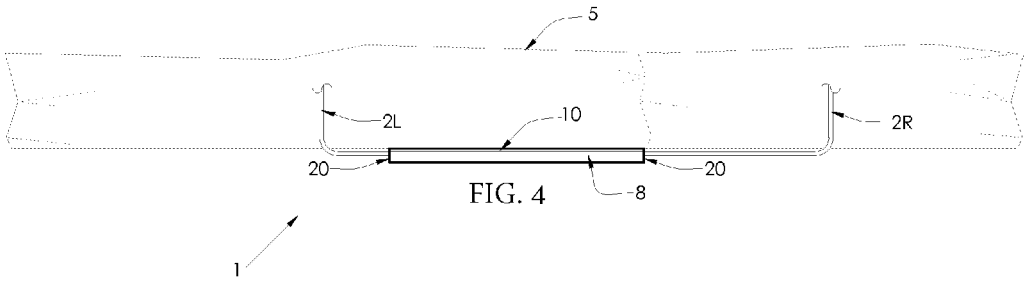
FIG. 4 is a front plan view of the paper board embodiment tied around a bale of paper.
Figure 5:
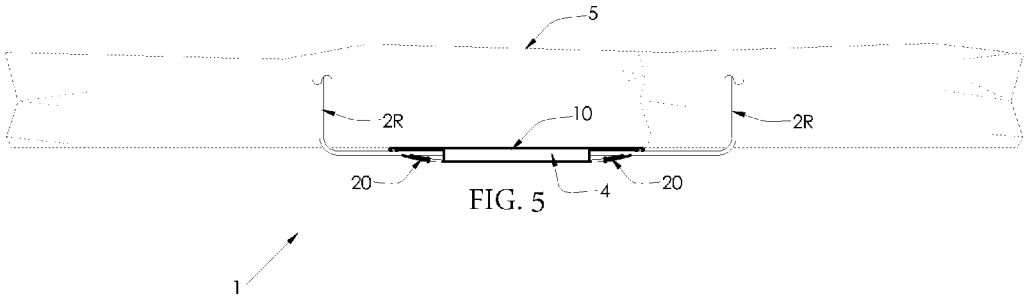
FIG. 5 is a right side view of the paper board embodiment, the left side view being a mirror image thereof.
Figure 10B:
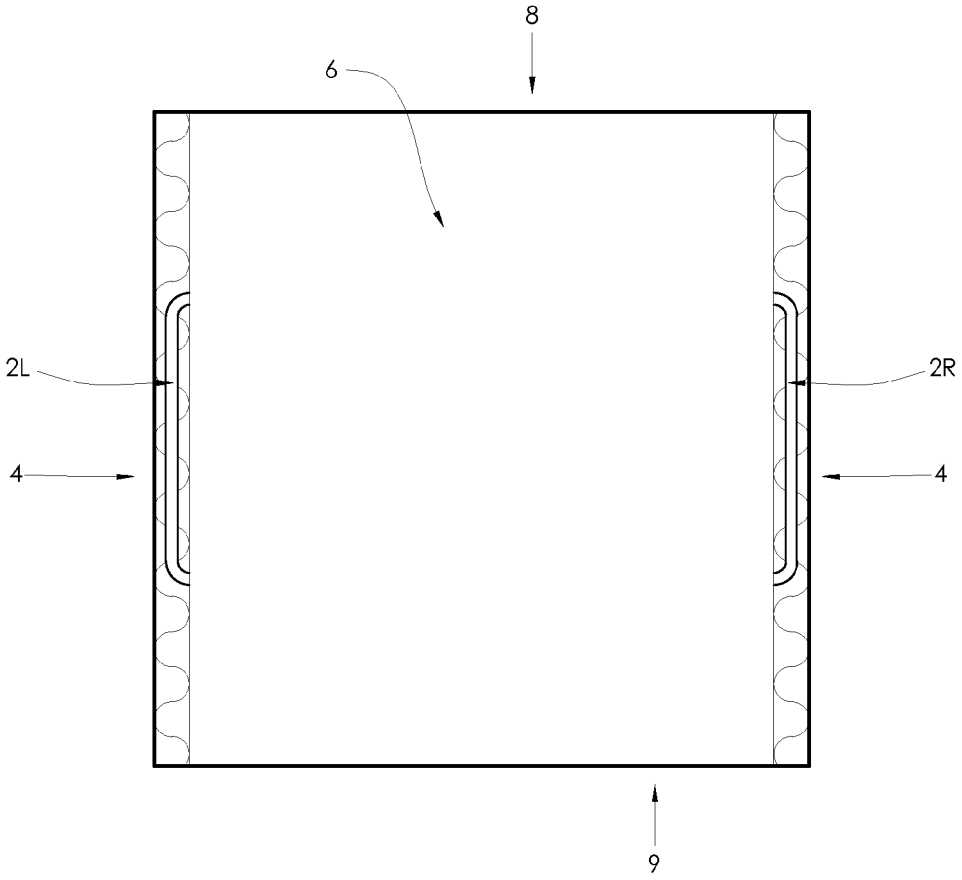
FIG. 10B is a bottom view of the cardboard embodiment showing the twine in a pre-used taut position against the right and left sides of the device.

By comparison, the cardboard embodiment as illustrated in FIGS. 2B and 10B, comprises a thin rectangular front and rear side created by the corrugated cardboard outmost grooves. In an alternative embodiment, a front and rear side is created from paper board, such as the bottom surface fabricated with perforation lines adjoining front and rear sides.

Additionally, the thickness of card board device 1 is determined largely by the thickness of the grooves in the cardboard, and is about $1/18^{th}$ of an inch. Conversely, the thickness of the paper board embodiment is a function of the folded layers: bottom surface, right and left sides, top surface, and is about $3/16^{th}$ of an inch.

Figure 8:
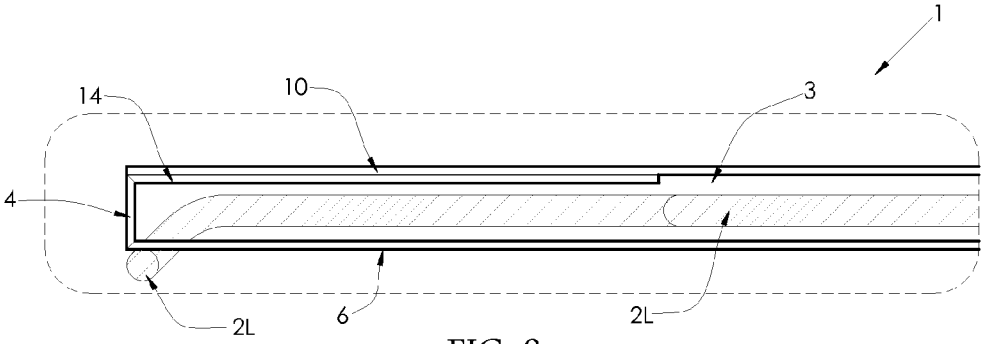
FIG. 8 is an exploded view of the left side of the paper board embodiment in FIG. 7.
Figure 9:
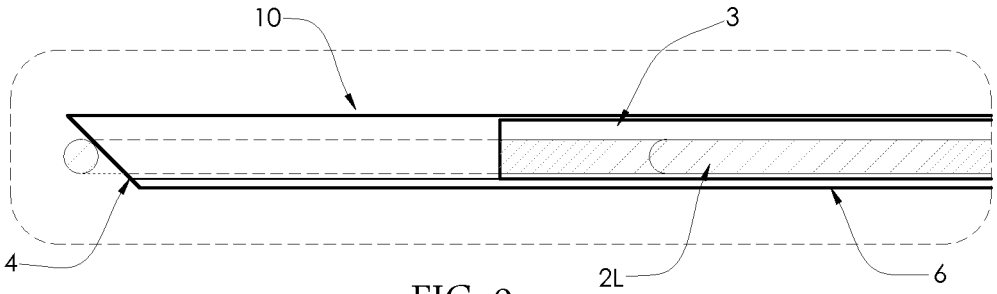
FIG. 9 is an exploded view of the left side of a cardboard embodiment similar to FIG. 8.

And in the exemplified cardboard embodiment of the FIGS. 2B, 9, 10, the right and left side 4 are angled downward and inward (e.g. about a 45 degree angle), whereas in the paper board embodiment the right and left side are positioned vertically and perpendicular to the top 10 and bottom 6 surface (e.g. FIG. 8 versus FIG. 9, left side "4"). This angle is created by the top surface 10 being marginally larger than the bottom surface 6. And, the cardboard embodiment is inherently stronger than the paper board embodiment because of the material it is made from, and is thus intended for use with heavier stacks.

Paper Board Embodiment Unassembled and Method of Assembly

FIG. 6A illustrates device 1 in a pre-used unassembled state for the paper board embodiment. As demonstrated, device 1 unassembled is a one piece unit, or blank, in the general shape of a "T" inverted (as positioned in FIG. 6A), comprising: a top section 10; a mid-section 6; a right and left side section 4; and a front section 12.

Top section 10 is rectangular shaped with two short and two long ends. It is positioned vertically with a short end adjoining the mid-section 6, along the mid-section's top long end. Top section 10 further comprises at least two horizontal perforation lines. The bottom perforation line 26 marks the location and means by which section 10 rotates to overlay mid-section 6. And the top perforation line 24 facilitates the means for sealing device 1—e.g. by folding it over section 12 while adhesive lines either the top end of section 10 or section 12.

In the exemplified embodiment, top section 10 is about 3.5 inches in length between perforation lines 24, 26. And the distance from perforation line 24 to the top end of the device is about $3/8^{th}$ of an inch and may further comprises adhesive to seal device 1 closed when adjoined to section 12; and the distance from perforation line 26 to the bottom end where cutouts 20 reside is about $9/16^{th}$ of an inch.

Mid-section 6 is also rectangular shaped comprising two long (about 3.5 inches in length) and two short ends (about 2.5 inches in length), positioned horizontally between the top section 10 and a thin rectangular bottom section 12. The mid-section 6 also comprises a one piece loop of twine 2 crisscrossed, or over-lapped, in the center of section 6. When device 1 is assembled, it creates a cavity 3 for the twine 2 to be rolled up and stored in untangled on top of the crisscross until the device is used and the loop ends 2R, 2L are pulled on, simultaneously, to extend the twine out from the holes 20.

The right and left side sections 4 are small rectangular shaped (as compared in size to sections 6 and 10); and they are vertically positioned. Section 4 long sides are about 2.5 inches in length, and the short sides are about 1 inch in length. Only the inner long side adjoins the mid-section 6 along inner vertical perforation line 28. Sections 4 also comprises an outer vertical perforation line 30 in close proximity and parallel to line 28. Perforation lines 28 and 30 are used for bending sides 4 onto mid-section 6 and under top section 10 to create vertical side walls about $3/16^{th}$ inches thick.

Paper board device 1 further comprises a thin rectangular bottom section 12 positioned horizontally positioned, with long ends 3.5 inches and short ends $9/16^{th}$ inches in length. Section 12 adjoins mid-section 6, both on their long sides, and opposite top section 10. When section 10 folds onto section 6 and section 12, section 12 is glued to the top end of section 10 above the perforation line 24. Therefore, in the exemplified embodiment of the paper board, the thickness of the device 1 assembled is $3/16^{th}$ of an inch from all sides. Additionally, when section 10 if folded onto sections 4, 6, and 12, it creates a front side 8 and a rear side 9 that is sharply angled downward and inward about 78 degrees.

Lastly, the blank paper board embodiment of device 1 comprises four semi-circle 20 cutouts that form the holes 20 for the twine 2 to extend from the device, when it is assembled. The twine loop is about 36 inches long but may be adjusted to fit the type and size of goods being stacked. A semi-circle cutout 20 is located on the device outer perimeter at each of two corners between the top section 10 and the mid-section 6; and at each of the two corners between the mid-section 6 and the bottom section 12. Furthermore, the diameter of the semi-circle cutout is slightly wider than a standard sized twine loop diameter so that the twine 2 may be pulled unimpeded from the cavity 3 (see FIGS. 10A, 11, "20").

The method of assembling the paper board embodiment of device 1, as viewed in FIG. 6, comprises: folding the right and left sides 4 onto the mid-section 6 (e.g. folding comprises rotating about 180 degrees) along their respective outer perforation line 28 and 30. The perforation on right and left sides 4 will then inherently create a device thickness sufficient to accommodate the thickness of the rolled twine 2 that is positioned in the middle of mid-section 6.

Then top section 10 is rotated (e.g. about 180 degrees) to lay over and be aligned with the sides 4 stacked atop of mid-section 6.

Cardboard Embodiment Unassembled and Method of Assembly

In the cardboard embodiment of device 1, the blank—unassembled—unit comprises a top section of a square piece of corrugated cardboard, about 3.5 inches in width and length, and covered with a bottom section of a flat un-corrugated piece of paper or cardboard.

Figure 6B:
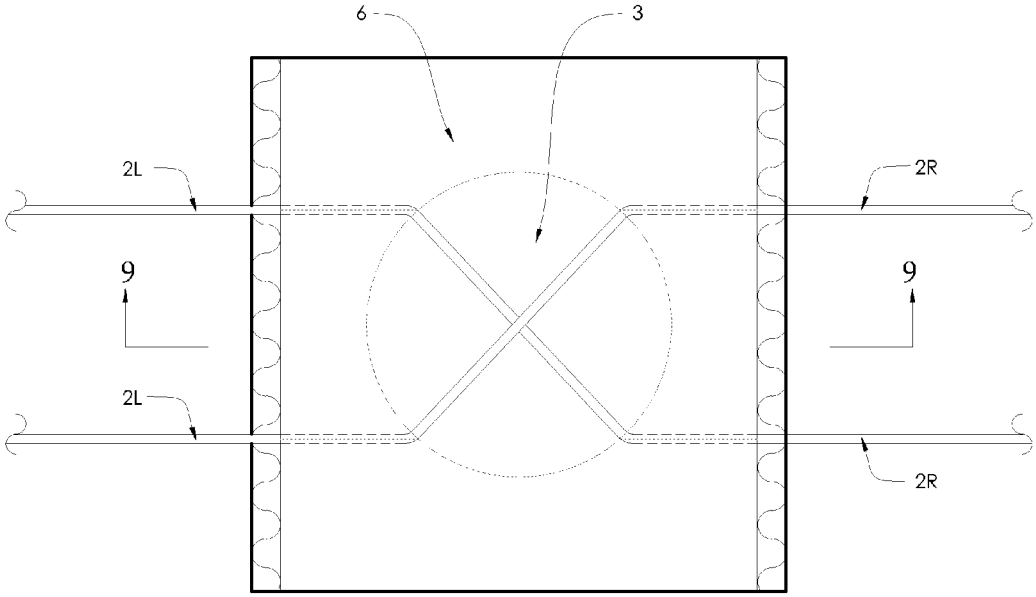
FIG. 6B is a top plan view of the cardboard embodiment in an unassembled configuration.
Figure 7:
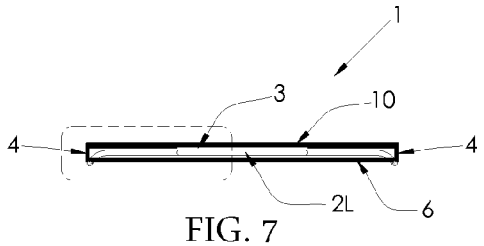
FIG. 7 is a cross-section front plan view of the paper board embodiment along projection line '7-7'.

The top section further comprises a circular cavity 3, about 2 inches in diameter, that is cut-into the center of the corrugated cardboard (see FIG. 6B). Cavity 3 is where the un-extended loop of twine is stored until device 1 is used.

The top section is also positioned so that the grooves in the corrugated cardboard extend between the right and left sides 4 of device 1. The grooves are thick enough in diameter and depth to allow twine 2 to slide through so that holes 20 are not needed to be fabricated into the device as in the paper board embodiment.

Assembling the device comprises laying the loop of twine into cavity 3 of the top section and extending two loop ends 2R, 2L to lie in a taut manner against the right and left sides 4 of the device 1 (see FIG. 10B). The bottom section, which comprises un-corrugated paper board or paper, that is glued over the top section with the body of the twine stored in cavity 3. In an embodiment exemplified in FIG. 9, the top corrugated section 10 is slightly wider from right to left than the bottom section 6 to create right and left sides 4 that are angled downward and inward at about a 45 degree angle. Device 1 as assembled will also have a thickness of about ⅛ inch as exemplified, but may comprise any thickness that the grooves and bottom section create.

Method of Use Exemplification

FIGS. 1-9 illustrate exemplifications of the paper board embodiment and the cardboard embodiment in using device 1 to bundle a stack of used newspapers.

In the paper board embodiment of FIGS. 1, 2A, 3-6A, 7 and 8, the two loop ends 2R, 2L extend simultaneously, and downwardly, from device 1's left and the right bottom surface (see FIGS. 7 and 8), over and around the stack 5, and are tied off in a knot on the top center of stack 5. As illustrated in FIG. 1, the two right ends 2R that extend perpendicularly from the right side and bottom surface of the device, form a closed loop section that is pulled over and around the right corner of stack 5 as configured in FIG. 1. Likewise, and simultaneously, the two left ends 2L that extend perpendicularly from the left side and bottom surface of the device, form a closed loop section that is pulled over and around the left corner stack 5 as configured in FIG. 1.

The two loops ends (2R, 2L), which are crisscrossed within cavity 3, are tied together at the center of the top surface 10 by a variety of knots well known to the skilled artisan. The two loops ends may also easily be adjusted by pulling on one or the other ends 2R, 2L to facilitate tying a particular type of knot and/or adjusting the lengths of the ends. Once the knot is securely tied, all four sections (2R, 2R, 2L, 2L) of the two opposing loop ends (right and left sided 4) are perpendicular to each other, and thus they secure each of the four sides of the stack or bale to prevent any item from dislodging.

The method of use of the cardboard embodiment is similar to the paper embodiment, with the exception that the two opposing loop ends 2R, 2L extend out the right and left side 4 of the device, versus from the bottom of the device in the paper board embodiment. FIG. 9 illustrates the card board embodiment in an expanded view of the left side of device 1. Loop end 2L extends out perpendicularly from the left side 4 of device 1.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention or claims herein. Consequently, all such modifications and variations and substitutions are included within the scope of the invention as defined by the following claims.

What is claimed is:

1. A recyclable, portable, hand-sized baling device for stackable consumer goods, comprising:

a top surface and a bottom surface, aligned, wherein said surfaces are rectangular or square shaped and comprising four corners, and the top surface is larger than the bottom surface;

a cavity centered between the top surface and the bottom surface, and wherein the cavity is rectangular shaped and at least the size of the bottom surface, or circular shaped;

a right side and a left side, and a front side and a rear side;

a closed loop of a single piece of twine comprising two opposing loop ends and a body, the opposing loop ends extendable from the right side and the left side simultaneously, and the body of the closed loop housed within the cavity; and, wherein the closed loop of twine is long enough for the two opposing ends to encircle a bale of stackable consumer goods.

2. The baling device of claim 1, further comprising:

the right side and the left side attached to the bottom surface and folded under the top surface; and, two holes on each of the right side and the left side, each of the holes wide enough for one loop end of twine to slide through.

3. The baling device of claim 2, wherein the device is made from paper board with the top surface longer than the bottom surface, and a downward, inward angle exists on the front side and rear side extending from the top surface to the bottom surface.

4. The baling device of claim 1, wherein the top surface comprises corrugated cardboard with grooves aligned horizontally and extendable between the right side and the left side, and the bottom surface comprises flat paper board.

5. The baling device of claim 4, wherein the cavity is circular shaped, and carved into a center of the top surface, and positioned to house the body of the closed loop of twine.

6. The baling device of claim 5, wherein the two opposing ends of the closed loop of twine extend from the circular cavity through the cardboard grooves and are extendable from the right side and the left side simultaneously.

7. The baling device of claim 4, wherein the top surface is wider than the bottom surface, and a downward, inward angle exists on the right side and the left side extending from the top surface to the bottom surface.

8. The baling device of claim 1, wherein each opposing loop end of the closed loop of twine is extendable from bottom center of bale of goods, around perpendicularly adjoining sides of the bale, and is tie-able on top center of the bale to the opposing loop end.

9. The baling device of claim 1, wherein the body of the closed loop of twine is crossed within the cavity of the device.

10. The baling device of claim 1, wherein the consumer good is a stack of one or more of the following, or any combination thereof: folded laundry, legal and letter sized papers, paperback books, recyclable papers, magazines, and collapsed boxes.

11. The baling device of claim 2, wherein:

the top surface comprises a top rectangular section comprising two long ends and two short ends, and positioned vertically with a short end adjoining a rectangular mid-section long end;

the bottom surface comprises a rectangular mid-section comprising two long ends and two short ends, positioned horizontally between the top section and a thin rectangular bottom section;

the right side and the left side each comprise a small rectangular side, section positioned vertically on opposing sides of the rectangular mid-section;

the rear side comprises a thin rectangular bottom section positioned horizontally and opposing the top section, and adjoining the mid-section;

the holes each comprise a semi-circular cutout located on a device outer perimeter at each of two corners between the top section and the mid-section and at each of the two corners between the mid-section and the bottom section, wherein a diameter of the semi-circle cutout is wider than a twine loop diameter; and wherein the top surface, the bottom surface, the right side, the left side and the holes form a single flat piece of folded paper board.

12. The baling device of claim 11, further comprising a plurality of perforations to enable configuration of the top section as the device top surface, the mid-section as the device bottom surface, and the two small rectangular side sections as the right side and the left side.

13. A method of bundling, transporting and disposing of small stackable consumer goods, comprising:

a. providing a baling device comprising, a top surface and a bottom surface, aligned, wherein said surfaces are rectangular or square shaped and comprising four corners, and the top surface is larger than the bottom surface;

a cavity centered between the top surface and the bottom surface, and wherein the cavity is rectangular shaped and at least the size of the bottom surface, or circular shaped;

a right side and a left side, and a front side and a rear side;

a closed loop of a single piece of twine comprising two opposing loop ends and a body, the opposing ends extendable from the right side and the left side simultaneously, and the body of the closed loop housed within the cavity; and, wherein the closed loop of twine is long enough for the two opposing loop ends to encircle a bale of stackable consumer goods;

b. pulling the two opposing loop ends simultaneously over opposing corners of the consumer goods;

c. tying the two opposing loop ends into a secure knot in a center of a top surface of the consumer goods, thereby bundling the consumer goods; and d. lifting, transporting, dropping and disposing of the bundled consumer goods by securely holding the knot one-handedly, wherein the consumer goods do not slip from the bundle.

14. The method of claim 13, wherein the baling device further comprises:

the right side and the left side attached to the bottom surface and folded under the top surface; and, two holes on each of the right side and the left side, each of the holes wide enough for one loop end of twine to slide through.

15. The method of claim 13, wherein the top surface comprises a corrugated cardboard with grooves aligned horizontally and extendable between the right side and the left side, and the bottom surface comprises flat paper board.

16. The method of claim 15, wherein the circular cavity is carved into the center of the top surface and positioned to house the body of the closed loop of twine.

17. The method of claim 16, wherein the two opposing loop ends of the closed loop of twine are extended from the circular cavity through the cardboard grooves and from the right side and the left side simultaneously.

18. The method of claim 13, wherein the goods comprise one or more of, or any combination thereof: folded laundry, legal and letter sized papers, paperback books, a stack of newspapers, magazines, and collapsed boxes; and wherein each opposing loop end extends from the bottom center of the bale, around perpendicularly adjoining sides of the bale, to the center of the bale top surface.

19. The method of 13, wherein in the device:

the top surface comprises a top rectangular section comprising two long and two short ends, and positioned vertically with a short end adjoining a rectangular mid-section long end;

the bottom surface comprises a rectangular mid-section comprising two long ends and two short ends, positioned horizontally between the top section and a thin rectangular bottom section;

the right side and left side comprising small rectangular side sections, one each positioned vertically on opposing sides of the rectangular mid-section;

the rear side comprising a thin rectangular bottom section positioned horizontally and opposing the top section, and adjoining the mid-section;

the holes comprising a semi-circle cutout located on the device outer perimeter at each of two corners between the top section and the mid-section, and at each of the two corners between the mid-section and the bottom section, wherein a diameter of the semi-circle cutout is wider than a twine loop diameter; and wherein the top surface, the bottom surface, the right side, the left side and the holes form a single flat piece of folded paper board.

20. The method of 19, wherein the device further comprises a plurality of perforations positioned for folding the two small rectangular right side and left side sections over the mid-section, and folding the top section over the two side sections and the mid-section, and securing a top end of the top section to the thin rectangular bottom section.

* * * * *